US006972676B1

(12) United States Patent
Kimmel et al.

(10) Patent No.: US 6,972,676 B1
(45) Date of Patent: Dec. 6, 2005

(54) METHOD AND APPARATUS FOR REMOTELY MONITORING A SITE

(75) Inventors: David E. Kimmel, Fredericksburg, VA (US); James T. Byrne, Jr., Chesterfield, VA (US); Donald R. Jones, Jr., New Canton, VA (US); Ronald Dubois, Dumfries, VA (US)

(73) Assignee: NetTalon Security Systems, Inc., Fredericksburg, VA (US)

( * ) Notice: Subject to any disclaimer, the term of this patent is extended or adjusted under 35 U.S.C. 154(b) by 631 days.

(21) Appl. No.: 10/069,788

(22) PCT Filed: Sep. 1, 2000

(86) PCT No.: PCT/US00/23974

§ 371 (c)(1),
(2), (4) Date: Feb. 28, 2002

(87) PCT Pub. No.: WO01/16912

PCT Pub. Date: Mar. 8, 2001

Related U.S. Application Data

(63) Continuation-in-part of application No. 09/387,496, filed on Sep. 1, 1999, now Pat. No. 6,281,790.

(51) Int. Cl.[7] ..... G08B 29/00

(52) U.S. Cl. ..... 340/506; 340/511; 340/517; 340/520; 340/521; 340/524; 340/525; 340/3.1; 340/825.36; 340/825.49

(58) Field of Search ..... 340/506, 511, 517, 340/520, 521, 524, 525, 825.06, 825.36, 340/825.49

(56) References Cited

U.S. PATENT DOCUMENTS 4,831,438 A 5/1989 Bellman, Jr. et al.

(Continued)

OTHER PUBLICATIONS

Design Specifications Of An Integrated Security System, ADC Technologies International PTE LTD, Feb. 1998, pgs. 1-42.

*Primary Examiner*—Daryl Pope
(74) *Attorney, Agent, or Firm*—Covington & Burling

(57) ABSTRACT

The present invention is directed to providing systems and methods for remotely monitoring sites to provide real time information which can readily permit false alarms to be distinguished, and which can identify and track the precise location of an alarm. In exemplary embodiments, monitoring capabilities such as intrusion/fire detection and tracking capabilities, can be implemented through the use of multi-state indicators in a novel interface which permits information to be transmitted using standard network protocols from a remote site to a monitoring station in real-time over preexisting communication networks, such as the Internet. A wireless network can also be established using browser encapsulated communication programs (for example, active X control, Java applets, and so forth) to transmit data packets which comply with any standard wireless local area network protocol. Communications can thereby be established between a web server embedded in a centrally located host monitoring station and a separate security panel deployed in each of the buildings to be remotely monitored. In exemplary embodiments, communications can be handed off from the centrally located host monitoring station to a mobile monitoring station (for example, to a laptop computer in a responding vehicle, such as a police or fire vehicle). The handoff can be such that direct communications are established between a security panel site being monitored and the laptop, or over, for example, a cellular network or indirect communications can be established via the host monitoring station.

33 Claims, 12 Drawing Sheets

U.S. PATENT DOCUMENTS 5,027,383 A 6/1991 Sheffer
5,086,385 A 2/1992 Launey et al.
5,400,246 A 3/1995 Wilson et al.
5,406,324 A 4/1995 Roth
5,576,972 A 11/1996 Harrison
5,619,183 A 4/1997 Ziegra et al.
5,652,849 A 7/1997 Conway et al.
5,708,417 A 1/1998 Tallman et al.
5,717,379 A 2/1998 Peters
5,801,921 A 9/1998 Miller
5,831,666 A 11/1998 Palmer et al.
5,850,352 A 12/1998 Moezzi et al.
6,229,429 B1 5/2001 Horon
6,281,790 B1 * 8/2001 Kimmel et al. ..... 340/506
6,369,695 B1 4/2002 Horon

* cited by examiner

METHOD AND APPARATUS FOR REMOTELY MONITORING A SITE

This application claims priority under 35 U.S.C. §§ 119 and/or 365 to International Application No. PCT/US00/23974 filed in the U.S. Receiving Office of the U.S. Patent and Trademark Office on Sep. 1, 2000 which is a continuation in part of U.S. application Ser. No. 09/387,496 filed in the USA on Sep. 1, 1999, which in turn is now U.S. Pat. No. 6,281,790 issued Aug. 28, 2001; the entire content of which is hereby incorporated by reference.

BACKGROUND OF THE INVENTION

1. Field of the Invention

The present invention relates generally to monitoring a remote site. More particularly, the present invention is directed to monitoring a remote site by providing real time transmission of outputs from a plurality of digital and/or analog multistate sensors which detect intrusion and/or fire, and communicate this information in an efficient, and effective format.

2. Background Information

Existing intrusion detection systems and their respective monitoring stations typically provide binary off/on alert information to the user. Known security systems employ binary status detection devices due to the availability and low cost of these sensors, and report only active (versus inactive) alarm status information. For example, an indicator, such as a lamp or audible output, is on when a particular sensor is tripped, and is off when the sensor is reset. Some known methods capture dynamic point state transitions using, for example, latching sensors that hold a transition state for a limited period of time, then reset automatically.

Systems that offer more detailed information resort to specialized communication protocols and proprietary interconnection solutions. For example, monitoring systems for property protection and surveillance are known which transmit live audio and/or video data. However, because a large number of video surveillance cameras is not only cost prohibitive, but generates large quantities of data that cannot be easily transmitted to remote monitoring sites in real time, these systems have not achieved the wide spread use associated with binary off/on systems.

Systems that supply binary off/on alert information, even sophisticated systems that employ multiple sensors in a monitored space, only resolve alert information to a particular sector, or zone, of the building under surveillance. Thus, information such as the precise location of a potential intruder, is not provided for responding police officers. More importantly, even when a large number of sensors is used to increase the resolution of alert information, the use of binary on/off indicators prohibits any ability to track an intruder's movement through the building and yet still be able to resolve the current location of the intruder.

In addition, known binary off/on systems can not distinguish whether an alarm is real (i.e., genuine) or false. When police arrive on the scene of a building where an alarm was tripped, they do not know whether the alarm is real or false and they are blind to what is inside the building. Substantial time and money is expended in having police respond to large numbers of false alarms. In situations where the alarms are valid, the police do not know this for certain, and can be taken by surprise. They enter the building not knowing where the subject(s) might be.

The same drawbacks exists for fire monitoring and surveillance systems. Although fire alarm systems are often tied directly into the local fire company, the false/real alarm discrimination, exact location of the fire, and the movement of the fire are unknown to the fire company which receives and responds to the alarm.

Accordingly, it would be desirable to provide a system and method for monitoring a remote site, whereby the false/real alarms can be accurately distinguished, and whereby movement of intruders or fire can be reliably tracked while still pinpointing the precise location of the intruder or fire. It would also be desirable to provide this information to monitoring sites, for use by responding personnel, in real time.

SUMMARY OF THE INVENTION

The present invention is directed to providing systems and methods for remotely monitoring sites to provide real time information which can readily permit false alarms to be distinguished, and which can identify and track the precise location of an alarm. In exemplary embodiments, monitoring capabilities such as intrusion/fire detection and tracking capabilities, can be implemented through the use of multistate indicators in a novel interface which permits information to be transmitted using standard network protocols from a remote site to a monitoring station in real-time over preexisting communication networks, such as the Internet. A wireless network can also be established using browser encapsulated communication programs (for example, active X control, Java applets, and so forth) to transmit data packets which comply with any standard wireless local area network protocol. Communications can thereby be established between a web server embedded in a centrally located host monitoring station and a separate security panel deployed in each of the buildings to be remotely monitored. In exemplary embodiments, communications can be handed off from the centrally located host monitoring station to a mobile monitoring station (for example, to a laptop computer in a responding vehicle, such as a police or fire vehicle). The handoff can be such that direct communications are established between a security panel located at a site being monitored and the laptop (for example, over a cellular network), or indirect communications can be established via the host monitoring station.

The network can be used to provide the primary visual alarm status reporting that gives the monitoring authority (user) the ability to identify the precise location of an intrusion/fire, and to distinguish false alarms. Multiple state, or multistate, indications are provided to represent a sensor. For example, each sensor can be identified as being: (1) currently in alarm; (2) currently in alarm and acknowledged by a monitor; (3) recently in alarm; (4) not in alarm; (5) disabled; or (6) a non-reporting alarm. With these multistate indications, the movements of an intruder or fire can be tracked, and yet the precise location of the intruder/fire can still be identified. This additional tracking ability gives police/firemen a tactical advantage at the scene as they know the location of the subject/fire and can track any subsequent movements as they close to make the arrest and or fight the fire.

Generally speaking, exemplary embodiments of the present invention are directed to a method and apparatus for monitoring a space, the apparatus comprising: a security panel located at the space, said security panel having a plurality of sensors; and a monitoring system for receiving real time information regarding the space from the security panel over a network using a network protocol, said monitoring system including a graphic interface to display said information as multistate outputs associated with each of said plurality of sensors.

In accordance with alternate embodiments, an apparatus is provided for monitoring a space comprising: a security panel located at the space; and a monitoring system for receiving real time information regarding the space from the security panel over a network, said monitoring system including a graphic interface to display information that distinguishes false alarms from actual alarms.

Exemplary embodiments provide updated information, in real time, regarding the status of sensors associated with point alarms included in the space being monitored. The graphical display of information can be provided as a hierarchical representation of network-to-site-to-point status using a plurality of tiered screen displays. The supervisory monitoring system can be configured as a central or distributed monitoring system including, but not limited to, the use of a base station host computer which can optionally direct information to the user via a cellular telephone network and/or via paging service in real-time. Alternate embodiments can also include security measures, such as the pseudo-randomizing of port access to the network to secure command and control communications.

BRIEF DESCRIPTION OF THE DRAWINGS

Other objects and advantages of the present invention will become more apparent to those skilled in the art upon reading the detailed description of the preferred embodiments, wherein like elements have been designated by like numerals, and wherein.

DETAILED DESCRIPTION OF THE PREFERRED EMBODIMENTS

1. Functional Overview

Figure 1:
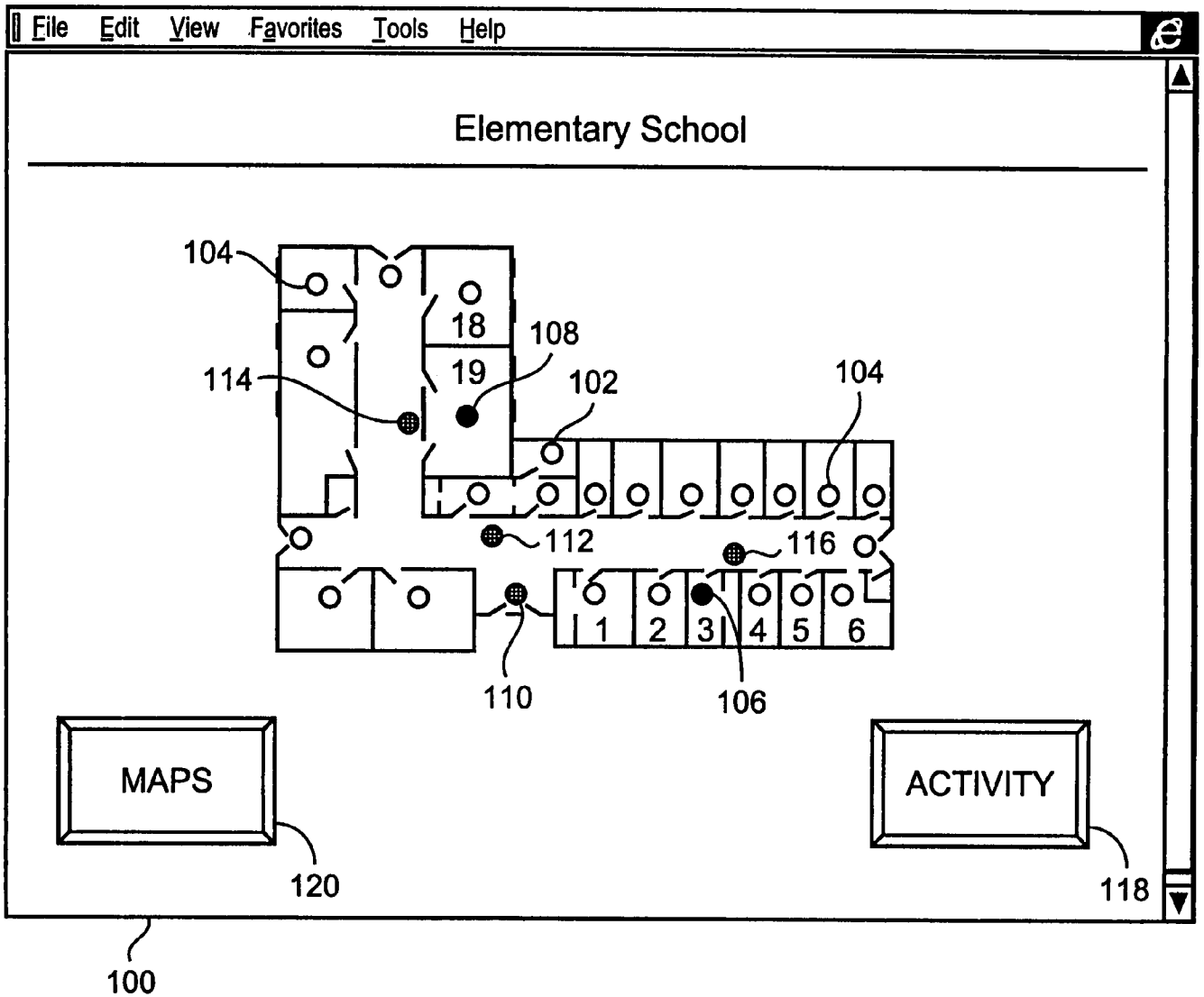
FIG. 1 shows an exemplary graphics screen viewed through a security panel web page, wherein the graphics display contains a floorplan layout, with special icons overlaid on a bitmap to identify sensor points and their status.

Before describing details of a system for implementing an exemplary embodiment of the invention, an overview of the invention will be provided using one exemplary display of information that is provided at a supervisory monitoring system's graphical user interface in accordance with the present invention. Referring to FIG. 1, the graphical user interface provides a screen display 100 of a particular floor plan 102 in a building being monitored for intrusion and/or fire detection. In the FIG. 1 example, a web browser included in the supervisory monitoring system is displaying a building floor plan 102 for an elementary school with its alarm points, and illustrates a two-person intrusion in progress. In this black/white rendition, points not in alarm are white circles 104. Two black circles 106, 108 indicate two points that are in simultaneous alarm. The gray filled circles 110, 112, 114 and 116 show alarms in a latched condition; that is, they were recently in alarm but, are not now in alarm.

Thus, at least three different states (for example, not in alarm; recently in alarm; and in alarm) are associated with the sensor located at each alarm point in the FIG. 1 floorplan to provide a multistate indication for each alarm point at the user interface. Of course, those skilled in the art will appreciate that any number of states can be provided, such as additional states to represent inoperable or disabled alarm points. For example, as will be described with respect to an exemplary embodiment, six such states can be used.

The user can apply pattern discrimination through visual representation of alarm point conditions provided by the display at a moment in time, referenced herein as an "event slice", to precisely understand and convey the nature of the intrusion. By monitoring the display of alarm states, false alarms can be readily distinguished from genuine alarms (that is, actual intrusions and/or fires). For example, a mouse cursor associated with the supervisory monitoring system's graphical user interface can be positioned next to a particular alarm point icon to access additional alarm point information. This alarm point information can identify the type of sensor situated at the alarm point (for example, glass breakage detector, smoke detector, and so forth) and the room number or area can be identified.

The FIG. 1 event slice associated with activity in the space being monitored (that is, a snapshot in time of a condition monitored at the graphical user interface), can be interpreted in the following manner:

a) The latch condition 110 represents a door sensor that has recently been in alarm and is now out of alarm;
b) The latch condition 112 represents a motion defector that was recently in alarm and is now out of alarm;
c) The latch conditions 114 and 116 represent motion detectors in the same state as latch condition 112; these conditions inform the user of two separate tracks (i.e., paths) of an intruder (or spread of a fire);
d) The two points 106, 108 are in simultaneous alarm. By positioning the mouse cursor at each of these points, the user can determine that these points are, for example, motion detectors in Rooms 3 and 19 of the school, respectively.

An analysis summary can be displayed to indicate that an intrusion occurred at the front door and that there are at least two intruders, one going left up the North hall and the other going right down the East hall. The display indicates that the intruders are currently in Rooms 3 and 19. An ACTIVITY icon 118 can be selected to review details of all time event data for each alarm point including, for example, the exact times for the break-in and the time frame of the intrusion for use by the user and/or law enforcement.

Real-time updates to the FIG. 1 display can be continuously received by the supervisory monitoring system over a communication network, such as an Internet/Ethernet communication network, for the purpose of subsequent tracking.

The supervisory monitoring system can include a host computer, configured with an embedded web server, that acts as the principal monitoring station for any number of security/fire alarm panels equipped with embedded web servers and located in one or more distinct spaces being monitored. Remote browsers, fixed and mobile, can also be iinked into the system from authorized police, fire, and private security departments.

Intrusion detection, tracking and subject location are accomplished in accordance with exemplary embodiments of the present invention using known sensor technologies in conjunction with a novel notification process. For example, the alarm point state conditions can be categorized into six fundamentally different states:

(1) A point currently in an alarm state;

(2) A point currently in an alarm state, and acknowledged by a monitor;

(3) A point recently in an alarm state, but unacknowledged as a current alarm;

(4) A point not in an alarm state;

(5) A point that has been disabled; and (6) A non-reporting point.

The last two states, disabled and non-reporting (or fail), represent inoperable point conditions. The remaining four active point conditions provide the monitoring operator a clear indication of which points are actively set into alarm, their simultaneity (multiple points of intrusion), and which alarms have been recently in a state of alarm but which are not currently in alarm. Each of the point conditions is represented on the screen display by a unique icon, combining shape and color for easy recognition.

Inoperable point conditions appear unobtrusive. They do not distract the operator from real-time alarms, but send a clear notification that these points are not contributing to the security monitoring process. When a point alarm is acknowledged by the supervisory monitoring station, the icon for that alarm point can be changed to appear less alerting (for example, change from a first color (such as, red) to a second color (such as, yellow)), allowing the operator to focus on new activity rather than the door that had been left open. The non-alarming point icon appears clearly visible, but not disturbing in color and shape. An icon that is alarming in color and shape represents the alarming point (unacknowledged).

While increasing the level of information displayed on the screen, the icons act as easily discernible symbols without cluttering the screen and confusing the operator. The increased level of information displayed provides the operator tools to recognize the presence of multiple intruders, the ability to discern a falsely-triggered alarm (isolated alarming sensor) from a legitimate alarm, and the visual "tracking" of their activity. The monitoring authority (user) can then apply pattern analysis to real-time changes in alarm states to discriminate between false and genuine alarms, and to track movement of an intruder or spread of a fire.

Generally speaking, a hierarchical approach can be used to pinpoint alarm conditions among plural spaces (for example, different buildings) being monitored. For example, a high level display can include a large geographical area, and can include indications of all facilities being monitored. Where any alarm in a given facility is tripped, the user can be notified in the high level display. By moving the cursor to that facility and clicking, a detailed floorplan such as that shown in FIG. 1 can be provided to the user.

The supervisory monitoring system can display an indication at the monitoring site's web browser within, for example, 1–4 seconds from the time a sensor located at the space being monitored is tripped into an alarm condition. A mouse click on the icon representing the facility in alarm directs the system to retrieve, for browser display, a floor plan schematic (such as that of FIG. 1) from the actual facility's security panel computer that displays all alarm points included in the facility and their current states. Subsequent changes in alarm point conditions are typically displayed in 1–4 seconds from the time an alarm is triggered in the facility.

Upon confirmation of activity, the monitoring authority can contact local law enforcement agencies that then direct an emergency response by hyperlinking to this same building visualization of alarm conditions using, for example, a remote browser located at the police/fire dispatch center. Responding officers at the scene can also access this visual display of alarm conditions by linking to that facility's security panel through a wireless LAN hub protocol and encapsulated browser communication broadcast instructions. For example, browser encapsulated communications programs (e.g., active X control, Java applets, and so forth) can be used. By clicking on a MAP icon 120, maps showing directions to the facility, or any other maps (such as complete floor plans of the facility) can be displayed.

In its fire monitoring role, the system can use the same encapsulated browser communication protocols to spawn real-time updates of changes in fire alarm points that are displayed visually on a monitoring site's web browser. Again, the visual display can be a building floor plan overlaid with icons detailing all fire alarm point sensors. Pattern analysis can be used to discriminate a genuine alarm from a false one and to track the spread of a real fire. Like police, firefighters at the scene can access the visual display of alarm conditions through a local wireless LAN hub utilizing conventional wireless communication protocols, such as protocols conforming with the IEEE 802.11 protocol standard, and browser encapsulated communication programs such as active X control, Java applets and so forth.

Thus, electronic security and fire alarm protection can be provided which permits real emergencies to be distinguished, and which provides law enforcement and fire fighters with real-time on-the-scene information for arrest-in-progress and/or effective fire fighting. Encapsulated browser communication programs are used so that real-time conditions of security and/or fire alarm points in a remote protected facility can be displayed on a central supervisory monitoring station's web browser and/or on remote, authorized browsers.

On-the-scene wireless connectivity can also be used by responding police/fire response units where these units connect into the live visualization to tract the intruder(s) or fight the fire. In both security and fire monitoring, embedded maps accessed via the MAPS icon 120 assist in getting response units quickly to the scene. Once on the scene, police officers or firefighters can access the visualization of alarm activity through a wireless interface of a remote browser residing on a laptop computer and the building's security panel containing an embedded web server. In accordance with exemplary embodiments, a unique communication protocol combines a conventional wireless protocol, such as the 802.11 wireless protocol, with encapsulated browser communications.

Exemplary embodiments can provide interactive reporting of facility security information between four basic subsystems over an Internet/Ethernet communications link. The four subsystems are:

(1) Security Panel

This subsystem directly monitors the status of individual sensors and reports their state to the requesting host, remote and mobile computer subsystems. Embedded web pages can be used to provide host, remote and mobile users detailed information on the site.

(2) Host Computer

This subsystem, through an embedded web server interface, provides a real-time display of a regional map depicting the location of all the sites within a security network and their status. Other remote subsystems used to remotely monitor the sites can gain access to the security panel at each site through the host computer web page. A local browser interface provides the host computer operator access to the same detailed information. Browser-encapsulated communications programs operating within the host maintain real-time status of the sites/alarm points and continually update the display screen.

(3) Remote Computer

This subsystem accesses the embedded web server within the host computer through, for example, an Internet browser program, which displays a map of the area sites and their current status. Using the mouse, a site can be selected to view the details of its status. Upon selection, the remote subsystem can be directly connected via a hyperlink to an embedded web server within the security panel. Similar to the host computer, the screen updates of site and point status is maintained through a browser-encapsulated communications program.

(4) Mobile Computer

The mobile computer can gain connectivity to the ethernet network local to the security panel through a wireless LAN, once it is within the operating range. "Broadcast packets" (for example, encrypted packets which can be decrypted by the mobile computer) can be sent by the security panel and be used to instruct the mobile computer how to directly access the security panel's web server through an Internet browser program. Once connected to the security panel web page, the mobile computer interface can operate like the remote computer.

2. General Communications Overview

Figure 2:
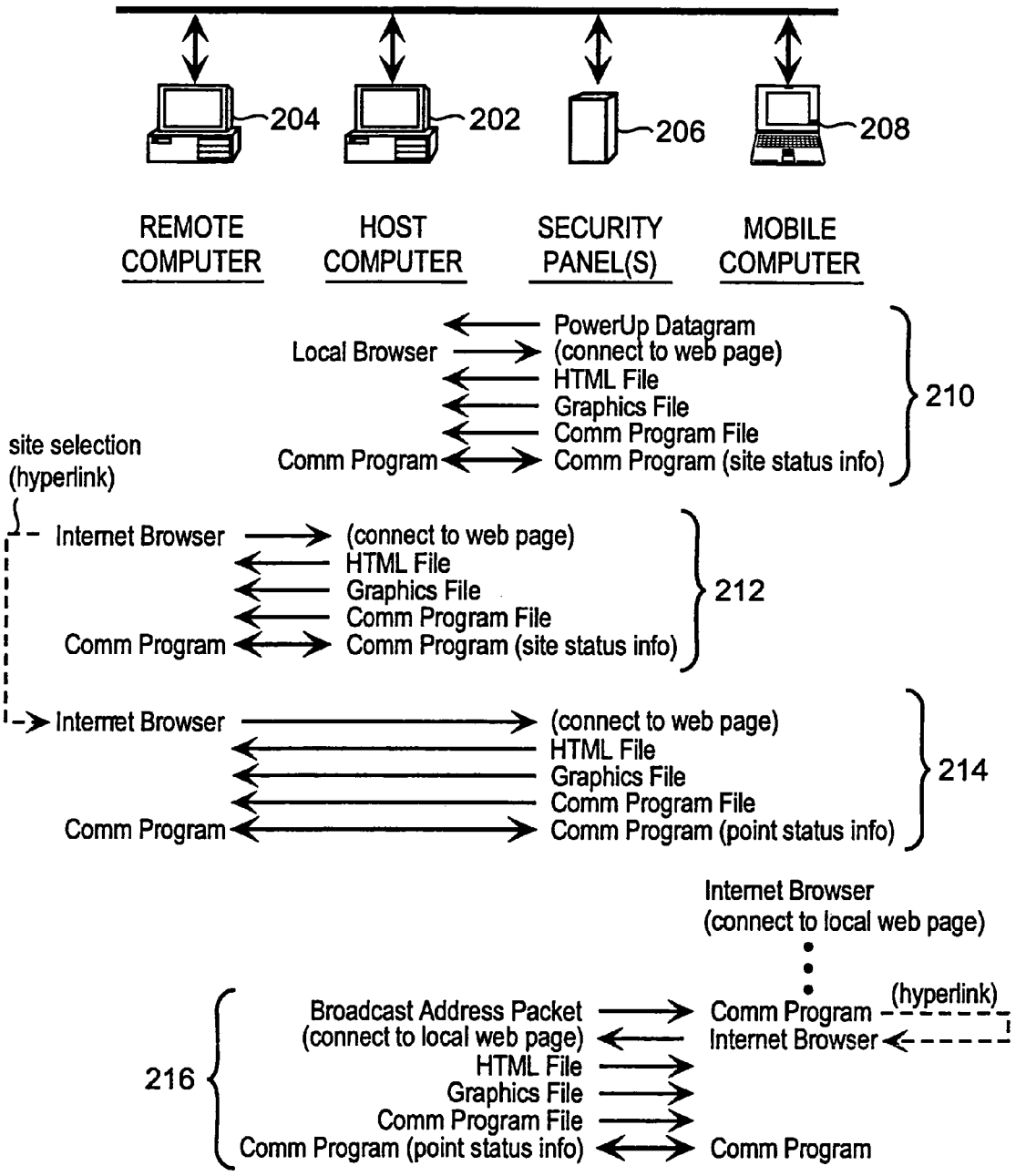
FIG. 2 shows a general overview of communications transpired between four basic subsystems.

Communications between the various subsystems are represented in FIG. 2. Standard browser and web server tools are combined with unique graphics and communication programs to effect real-time performance through minimal bandwidth.

FIG. 2 provides a general overview of the communications that transpire between the four basic subsystems; that is, (1) a host computer 202; (2) a remote computer 204; (3) security panel(s) 206; and (4) mobile computer 208. Communications between the host computer 202 and the security panel(s) are represented as communications 210, with arrows indicating the direction of information flow. For example, following a powerup indication from the security panel, and a connection by the host's local browser to the security panel's embedded web page, files regarding site information (such as floorplan) and alarm status information can be sent to the host. Similar protocols can be followed with respect to communications between the remaining subsystems. Communications between the host computer 202 and the remote computer 204 are represented as communications 212. Direct communications between the remote computer 204 and the security panel(s) 206 are represented as communications 214. Finally, direct communications between the security panel and the mobile computer are represented as communications 216.

Those skilled in the art will appreciate that the information flow represented by the various communications paths illustrated in FIG. 2 are by way of example only, and that communications from any one or more of the four basic subsystems shown in FIG. 2 can be provided with respect to any other one of the four basic groups shown, in any manner desired by the user. More detailed discussions of the specific communication paths in accordance with the exemplary embodiment illustrated in FIG. 2 will be described with respect to FIGS. 9–12. However, for a general understanding of the basic communications, a brief overview will be provided with respect to FIG. 2.

As illustrated in FIG. 2, most intersubsystem communications are initiated by executing a conventional Internet browser program (such as Microsoft's Internet Explorer, or Netscape) in accordance with an exemplary embodiment that is represented in FIG. 2 as an "Internet Browser". When the browser is directed to a specific site address (both the host computer and the security panel are assigned Internet protocol (IP) addresses), the browser software attempts to connect to the port at the IP address. The embedded web server at the addressed site recognizes the connect request at the port as a request to transfer the web page information (contained, for example, in a HTML file). Once transferred, the browser software begins to process the instructions within the HTML file. Within the file are references to a graphics file to be displayed and a communications program to be executed. If these files are not locally available, the browser software requests the transfer of the files from the host web server, using a hypertext transfer protocol (HTTP). Once received (and locally saved), the browser software displays and executes the files as directed by the HTML file.

The graphics files displayed serve as the bitmap background that the site and point status icons are written on, serving as visual status indicators to the monitoring operator. The communications program performs both the real-time communications between the subsystems and the painting of the status icons. When the communications reveal a change in point or site status, the screen icons are repainted to reflect the new conditions. These browser-encapsulated communication programs enable real-time performance over conventional communications networks such as the Internet.

3. System Overview

Figure 3:
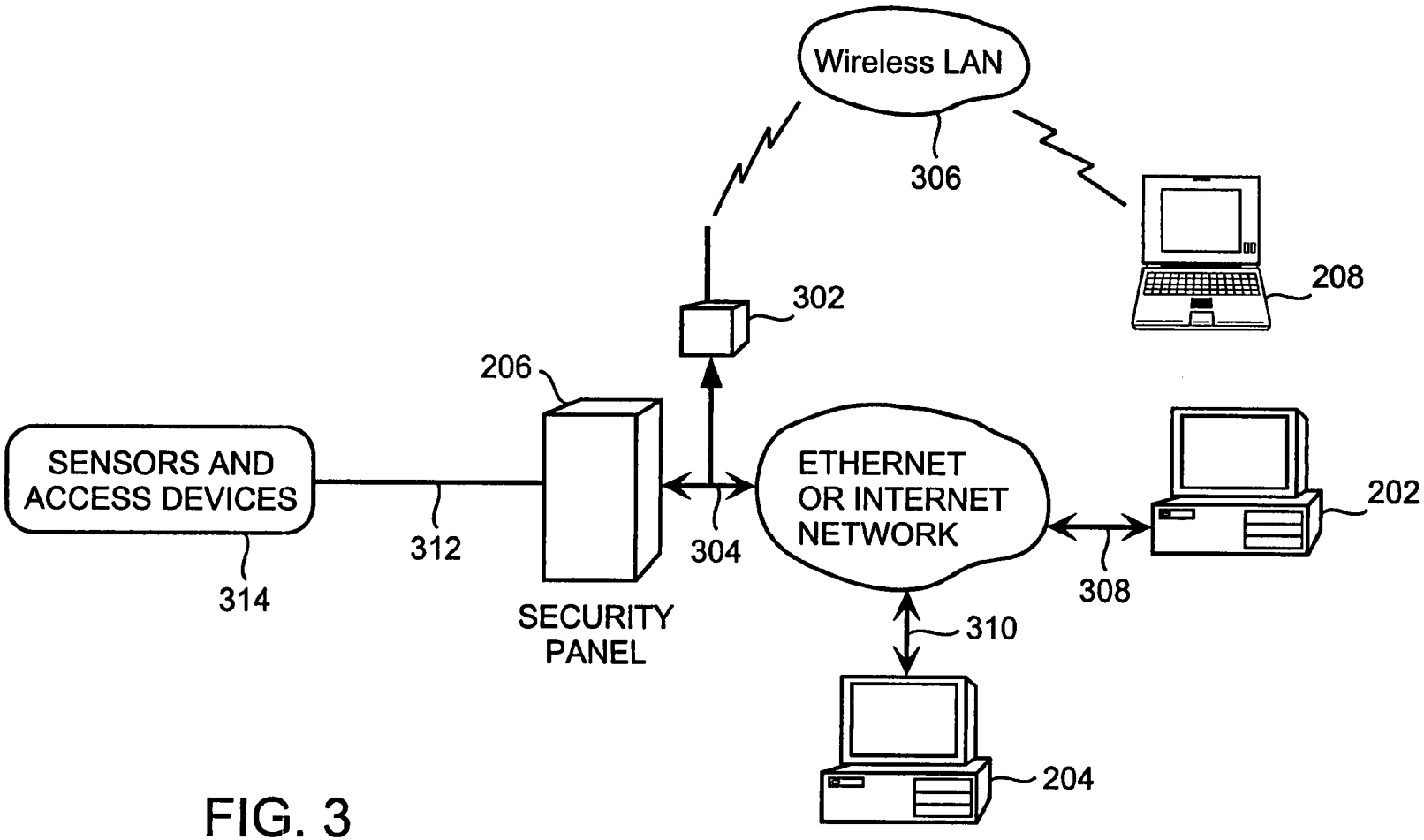
FIG. 3 show basic components of an exemplary system block diagram.

FIG. 3 depicts a general system block diagram of an exemplary security system, comprised of the security panel 206, the host computer 202, the remote computer 204, the mobile computer 208, and an optional wireless LAN hub 302. The security panel is installed within the space (that is, the physical facility) being monitored, and is permanently connected to an Internet or Ethernet network 304. The wireless hub 302 can be installed at the facility site to provide connectivity for the mobile computer 208 via a wireless LAN 306. The host computer 202 can be installed anywhere so long as it is connected to the same Internet or Ethernet network 308 to which the security panel is attached. The remote computer 204 can be installed anywhere so long as it can access the same Internet or Ethernet network 310 to which the host computer and the security panel are attached (permanent, dial-up, and so forth). The mobile computer 208 must be within the coverage area of the wireless LAN hub to access the security panel over the wireless LAN 306.

The security panel 206 monitors the status of security sensors 314 installed within the monitored facility via data links 312. When an enabled sensor changes state, a POINT STATUS message is sent to the host computer 202. The host computer, usually monitored by an operator, repaints the icons shown on its display screen to reflect the updated condition of the security panel. Any mobile computer or remote computer currently connected to the security panel reporting the changed point condition can also repaint the icons on their own display after the next status query response.

a. Host Computer

Figure 4:
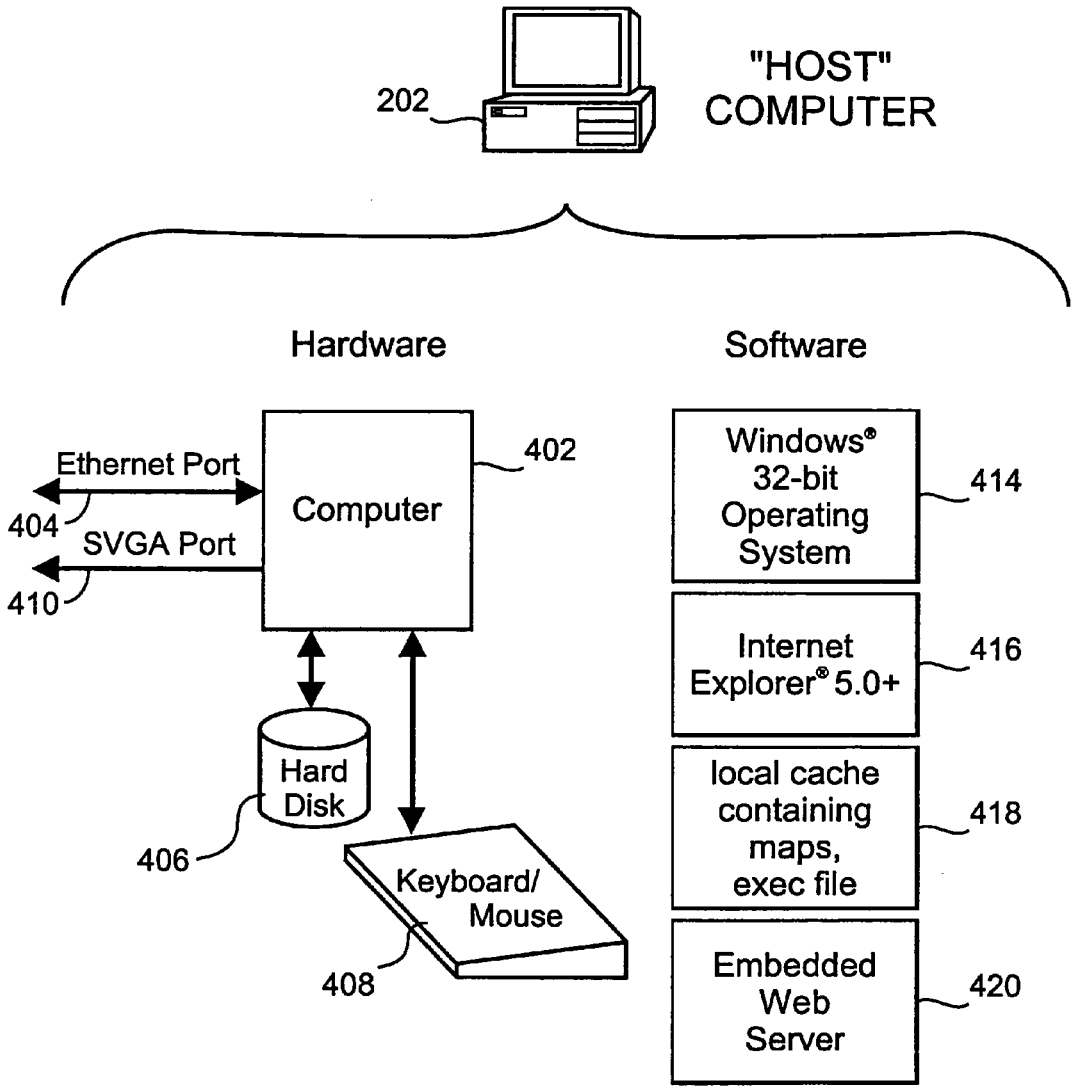
FIG. 4 shows a detailed diagram of an exemplary host computer in a supervisory monitoring system.

FIG. 4 details hardware and software components of an exemplary host computer 202. The CPU motherboard 402 for example, (e.g., based on Intel processor, such as 80486, Pentium I/II/III, or any other processor) is a conventional personal computer that will support any desired network operating system 414, such as any 32-bit operating system including, but not limited to the Microsoft NT Operating System 20. An exemplary motherboard will feature, or accommodate, Ethernet communications port 404 for interfacing with an Internet or Ethernet network. A hard disk 406 can be installed to support information storage. A keyboard and mouse 408 can be attached for operator interface. A display, such as an SVGA monitor can be attached via an analog or digital video graphics applications port 410 for a visual display unit. The NT Operating System 414 can be installed in a standard manner, along with the Internet Browser software package 416, such as Internet Explorer (any version, including version 5.0 or greater) available from Microsoft Corp. An embedded web server 420 is installed (such as the Microsoft personal web server or the GoAhead web server). A local cache directory 418 is installed with web page support tools: supporting graphic files (i.e. regional maps), encapsulated communications programs, local data files and any other desired information.

b. Remote Computer

Figure 5:
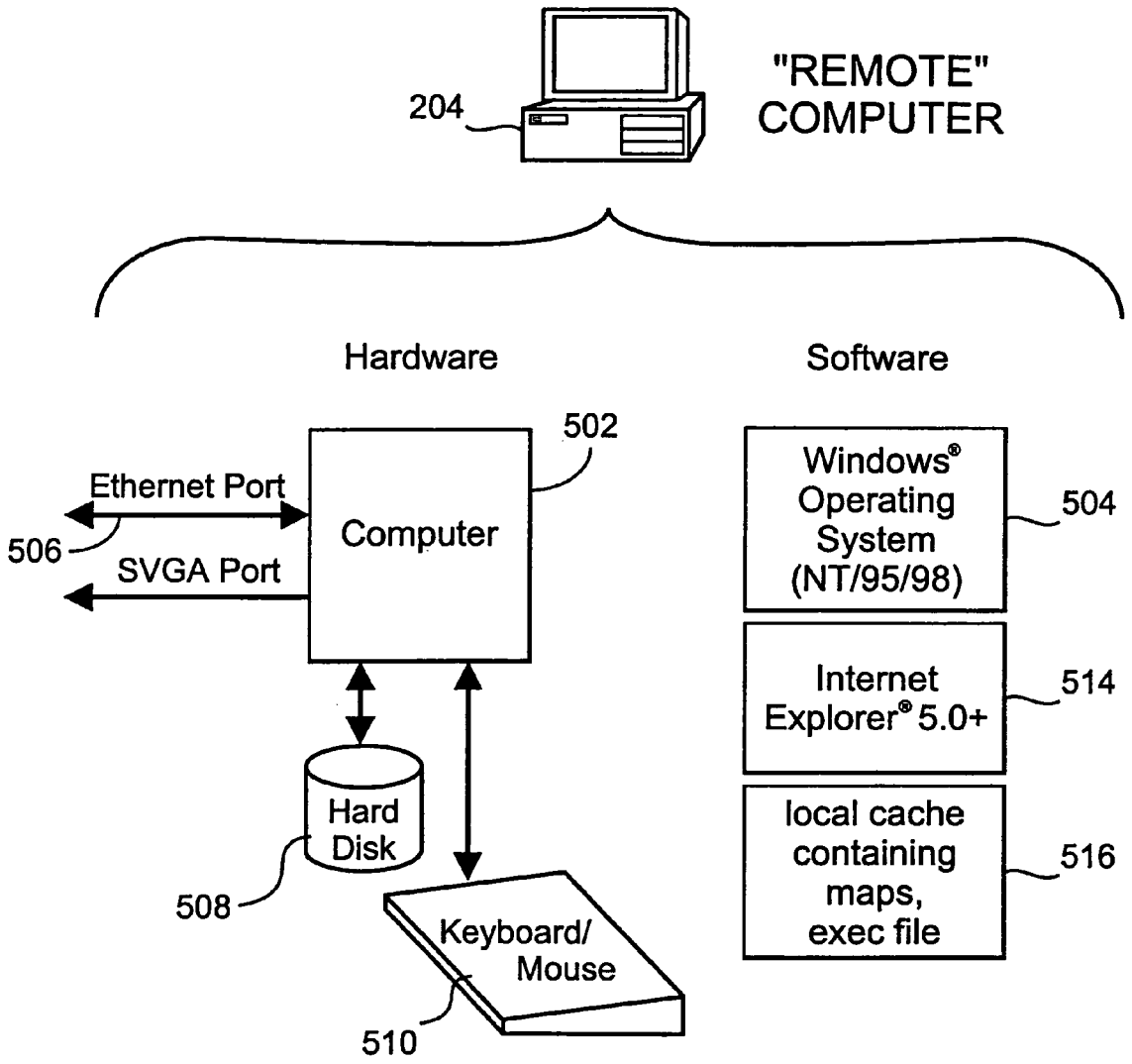
FIG. 5 shows a detailed diagram of an exemplary remote computer.

FIG. 5 details hardware and software components of the remote computer 204. The CPU motherboard 502 (e.g., based on Intel processor, such as 80486, Pentium I/II/III, or any other processor) is a conventional personal computer that will support the desired network operating system 504, such as any 32-bit operating system, including but not limited to the Microsoft NT Operating System 20. The motherboard will feature, or accommodate Ethernet communications 506 with an Internet or Ethernet network via Ethernet port 506. A hard disk 508 will support information storage. A keyboard and mouse 510 will provide operator interface. An SVGA monitor can be attached via port 512 for a visual display unit. The operating system 504 is installed in a standard manner, along with an Internet Browser software package, such as "Internet Explorer" package 514. A local cache directory 516 is installed with web page support tools: supporting graphic files (for example, individual room layouts, floorplans, side view of multi-story facility, and so forth), local data files, encapsulated communications programs, and local data files.

c. Security Panel

Figure 6:
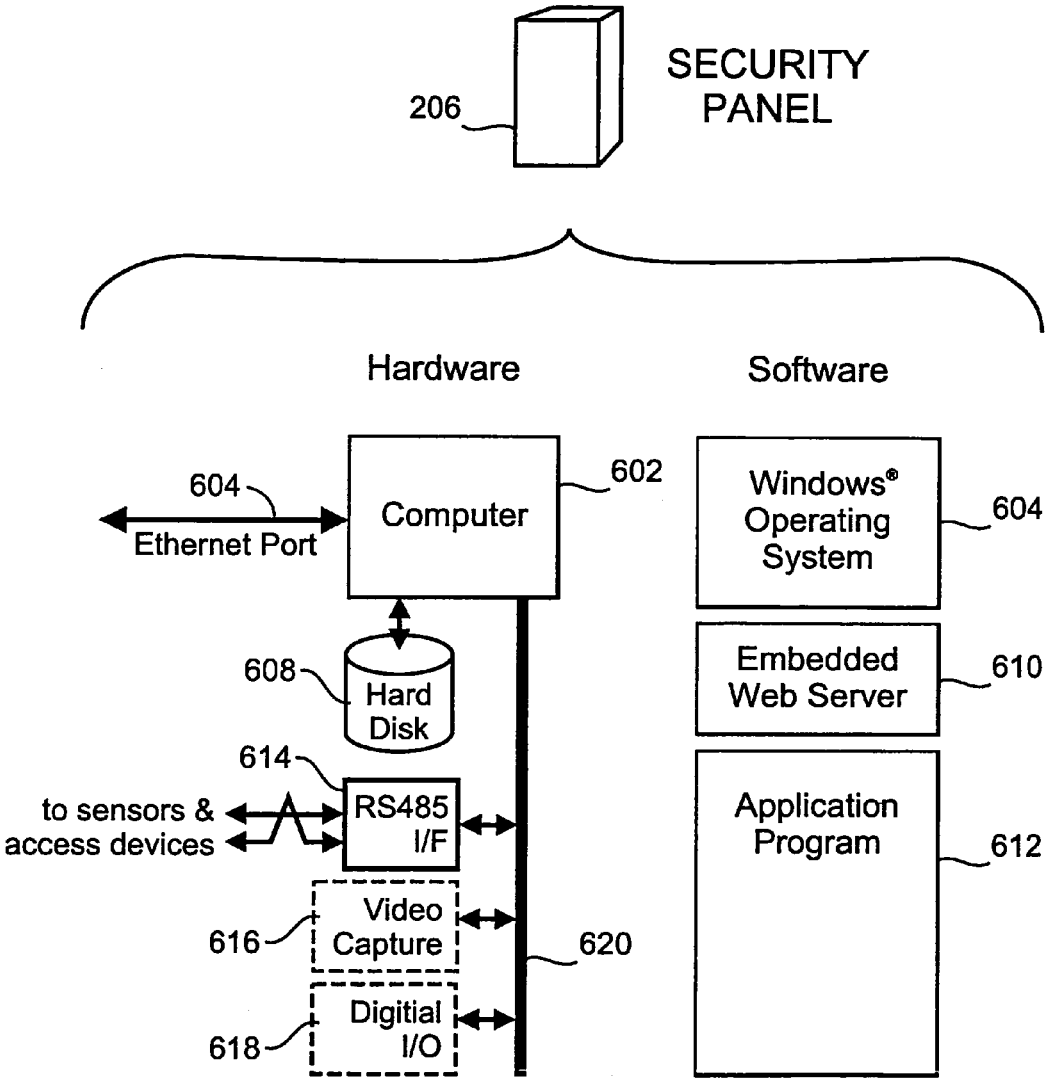
FIG. 6 shows a detailed diagram of an exemplary security panel.

FIG. 6 details hardware and software components of the Security Panel 207. The CPU motherboard 602 (e.g., based on Intel processor, such as 80486, Pentium I/II/III, or any other processor) is a conventional personal computer that will support the desired network operating system 604 such as any 32-bit operating system including, but not limited to the Microsoft NT Operating System 20. The motherboard will feature, or accommodate Ethernet communications with an Internet or Ethernet network via Ethernet port 606. A hard disk 608 will support information storage. The operating system can be installed in a standard manner. A Windows compatible embedded web server 610 is installed (such as those available from GoAhead software). A main application program 612 is also installed, including local data files. Communications protocols, such as RS485 communications protocols 614, are supported to facilitate communications with the sensors, sensor controller and other access devices. As supporting inputs, video capture boards 616 and direct digital I/O boards 618 can be added to the local bus 620.

d. Mobile Computer

Figure 7:
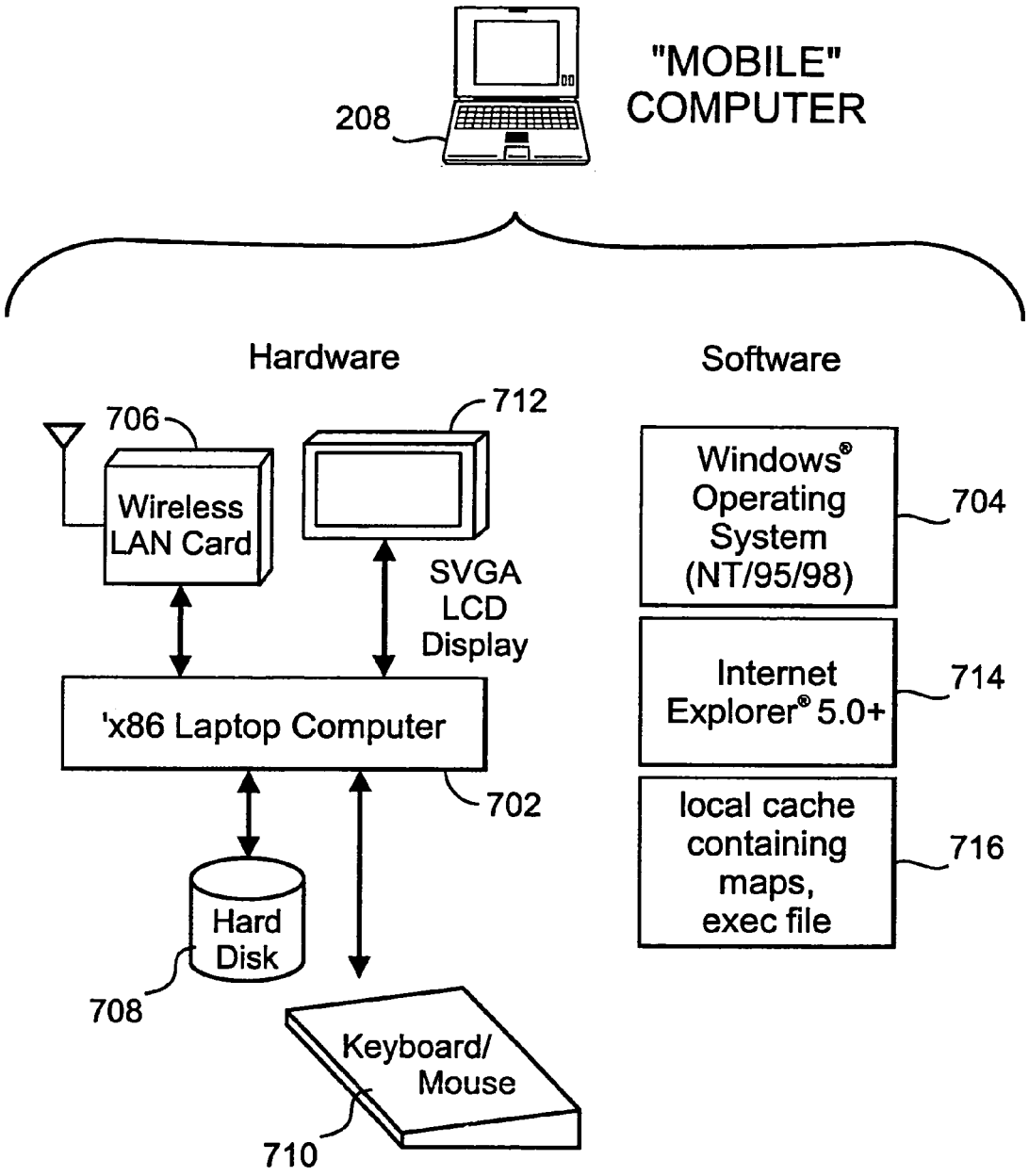
FIG. 7 shows a detailed diagram of an exemplary mobile computer.

FIG. 7 details the hardware and software components of the Mobile computer 208. The CPU motherboard 702 (e.g., based on Intel 80486, Pentium I/II/III, or any other processor) is a conventional laptop computer that will support the desired network operating system 704, such as any 32-bit operating system including, but not limited to the Microsoft NT Operating System 20. Add-on boards can be installed to interoperate with, for example, IEEE 802.11 Ethernet communications 706, compatible with the installed wireless hub 302 (shown in FIG. 3). A hard disk 708 is installed to support information storage. An integral keyboard and mouse 710 are attached for operator interface. A display, such as an SVGA LCD monitor 712 is attached for a visual display unit. The operating system can be installed in a standard manner, along with any Internet browser software package 714, such as Internet Explorer (for example, version 5.0 or greater). A local cache directory 716 is installed with web page support tools: supporting graphic files (i.e. individual room layouts, floorplans, side view of multi-story facility, and so forth), local data files, encapsulated communications programs, and local data files.

e. Screen Display

Figure 8:
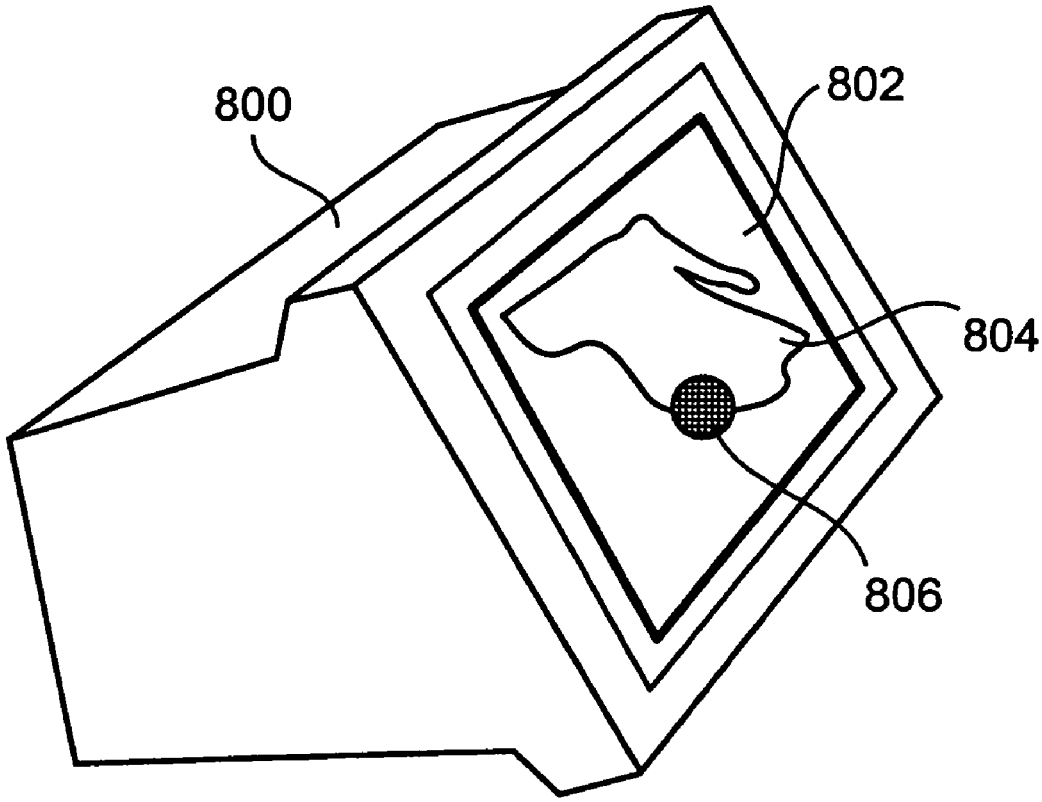
FIG. 8 shows an exemplary display screen.

FIG. 8 details screen display graphic components. These components are common to the screens available to the host computer, remote computer and mobile computer users. These display components are made available through, for example, the use of standard browser technology, encapsulated graphics data and real-time communications programs. When the browser software initializes, it generates the window frame 802 on the display 800. When the browser addresses an embedded web page within the host computer or security panel, an HTML file is transferred. Within the HTML file is a reference to an encapsulated graphic image file 804 to be displayed. This file represents, for example, a regional map, the facility floorplan, or an individual room layout. Also referenced in the HTML file is the execution of an encapsulated communications program 806. This communications program is spawned and operates in tandem with the browser software, maintaining real-time communications with the site containing the embedded web page.

The communications software queries and monitors the condition of the panel/point status of the remote sites. Upon initialization, and as new status is received, the communications program "paints" new icons 806 atop the graphics display, the icons representing the location and status of the depicted site/point.

In an exemplary embodiment, there are six states represented by the icons; (1) ALARM (point/site in alarm but not acknowledged), (2) ACKNOWLEDGED (ACK'D) ALARM (point/site in alarm and acknowledged by security monitor), (3) RECENT ALARM (point/site recently in alarm), (4) NORMAL (point/site not in alarm), (5) DISABLED (point/site disabled) and (6) FAIL (point/site not responding). These different states allow the monitoring user to determine the current and recent location of an intrusion, provide the visualization of multiple points of intrusion, and the ability to visually discriminate between legitimate and falsely-triggered alarms. All communications among the networked components are transferred using standardized data packets of any known network protocol.

4. System Communications a. Security Panel-Host Communications

Figure 9:
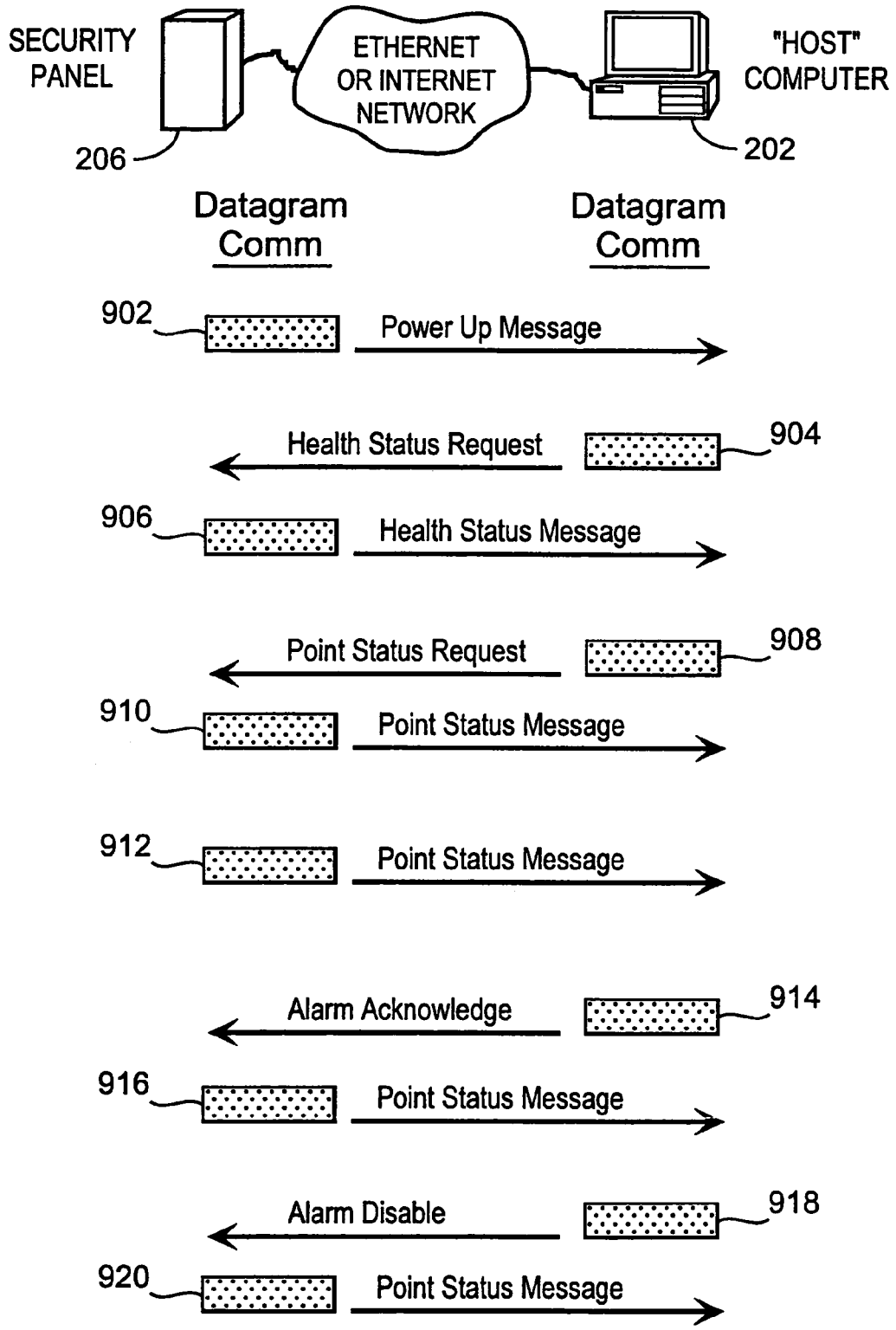
FIG. 9 shows exemplary communications between the security panel and the host computer.

FIG. 9 details the communications between the security panel 206 and the host computer 202. Upon the application of power, the security panel sends a PowerUp Message 902 to its designated host computer IP address. On regular intervals, the host computer sends a HEALTH STATUS REQUEST 904 datagram to each security panel. A repeated failure to receive a response packet 906 indicates to the host computer that the panel communications link has failed and its icon is updated. When received by the host computer, this message is logged into a local data file. When initially engaging communications with the security panel, the host computer sends a POINT STATUS REQUEST 908 to the security panel. Until an initial status has been determined, all icons are represented with an UNKNOWN icon (such as a circle with "?"). If the request repeatedly goes unanswered, the site is determined to be inoperative and is represented with a FAIL icon.

The successful receipt of the POINT STATUS response packet 910 causes the host computer to repaint the screen icons to represent their current determined condition. When an enabled point status has changed, the security panel sends a POINT STATUS message 912 to its designated host computer IP address. Upon its receipt, the host computer repaints the icons to represent the current status.

When a monitoring operator at the host computer wants to acknowledge an annunciated alarm condition, an ALARM ACK packet 50 is sent to the security panel, along with a reference to the alarm being acknowledged. When received by the security panel, the condition of the point is updated and a new POINT STATUS message 916 is sent back to the host computer. Again, the receipt of this packet causes the host computer to repaint the icons on the screen. If the monitoring operator wants to disable a point, group of points, or an entire site, an ALARM DISABLE message 918 is sent (containing a mask reference for the point array). When received by the security panel, the point condition(s) is(are) modified and a new POINT STATUS message 920 is sent in response. Its receipt by the host computer repaints the icons on the screen display.

b. Remote Computer-Host-Computer Communications

Figure 10:
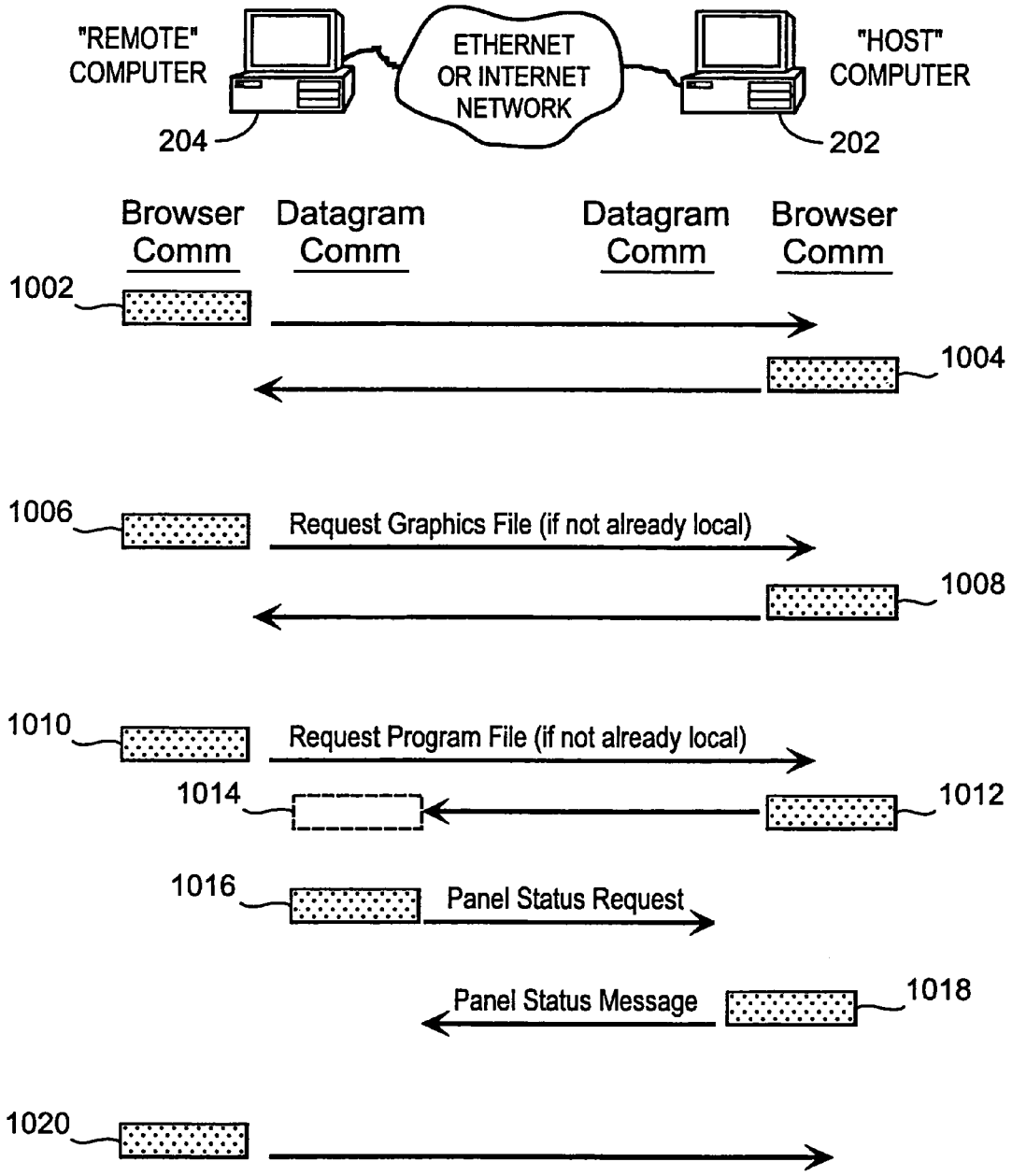
FIG. 10 shows exemplary communications between the host computer and the remote computer.

FIG. 10 details communications between the remote computer 204 and the host computer 202. When the remote computer user wishes to attach to the security system, it executes a compatible browser software package and connects to the Internet or Ethernet network (e.g., Internet Service Provider (ISP) dial-up, local hardwire, and so forth). When actively connected, the user directs the browser to the IP address of the host computer, seeking to connect to the host computer's web server 1002.

When accessed, the embedded web server software downloads the HTML file 1004 that defines the host and/or security panel web page(s). The HTML file includes the reference of a graphics file. If the current version of the file does not locally exist, the remote computer browser makes a request 1006 for the HTTP transfer of the graphics file from the host computer. Once received from the host computer in transfer 1008, the graphics file is locally stored (in cache directory) and is displayed on the browser screen. The HTML file then instructs the execution of a communications program. Again, if the current version of the file does not locally exist, the remote computer browser requests the HTTP transfer of the file from the host computer via request 1010.

Once received from the host computer in transfer 1012, the communications program file is locally stored and immediately executed at step 1014. This program runs in tandem with the existing browser software and does not prevent or hinder any normal browser activity. Once started, the communications program begins a continuous polling sequence, requesting the status of the various panel sites via requests 1016. When the communications program receives the response status messages 1018, all the icons overlaying the graphics screen are repainted to indicate the current status of the sites. When the remote computer user selects the icon of a site for more detail, the browser software can immediately hyperlink to the IP address of the selected security panel (connecting to the embedded web server within the panel in step 1020), and perform communications with the panel in a manner similar to that described with respect to the host computer and FIG. 9.

c. Remote-Security Panel Communications

Figure 11:
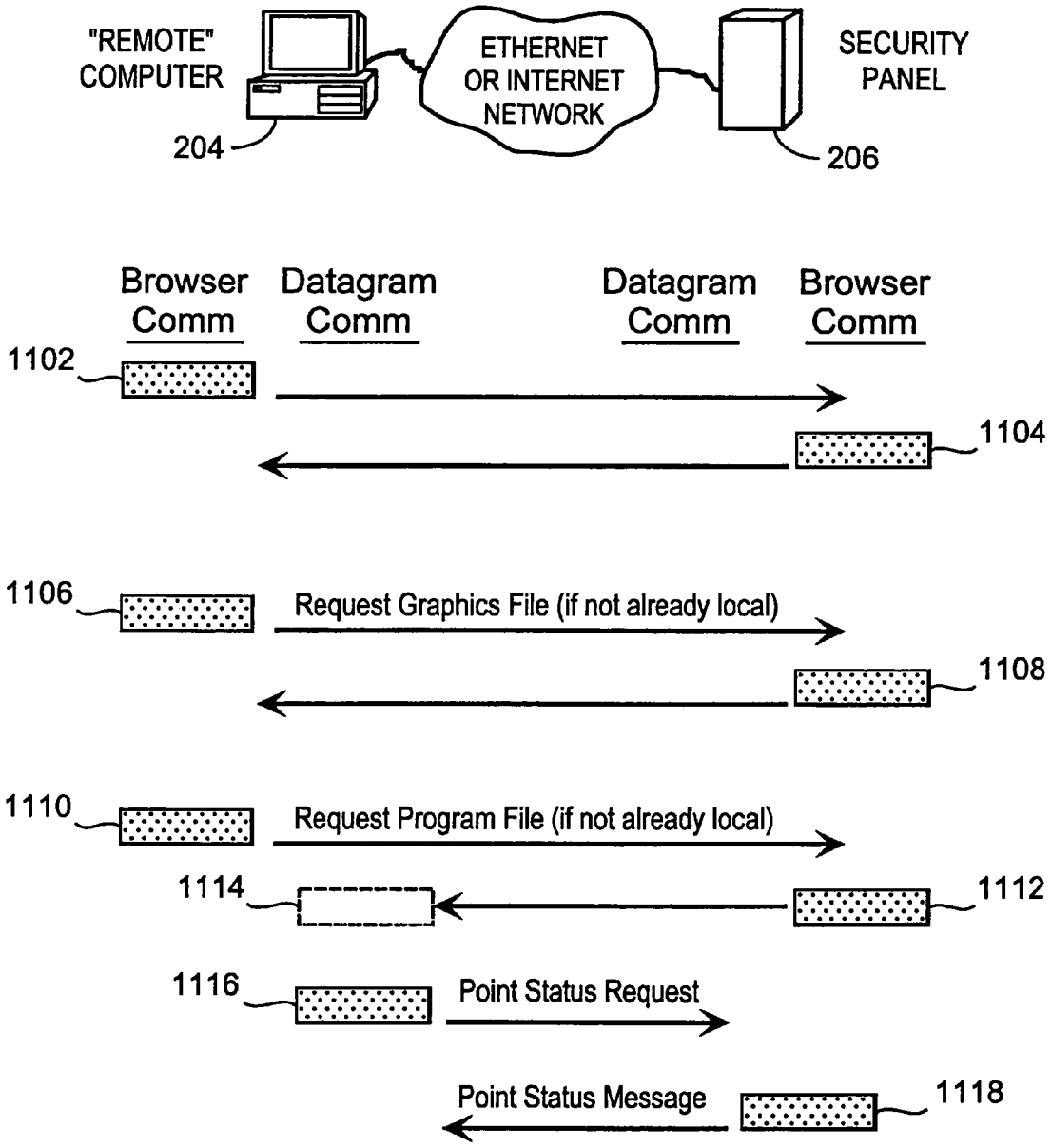
FIG. 11 shows exemplary communications between the security panel and the remote computer.

FIG. 11 details the communications between the remote computer 204 and the security panel 206. The remote computer gains access to the security panel through the host computer via a hyperlink connection. When selected, the browser is directed to the IP address of the security panel, seeking to connect to the security panel's embedded web page 1102. When accessed, the embedded web server software downloads the HTML file 1104 that defines the security panel's web page. The HTML file includes the reference of a graphics file. If the current version of the file does not locally exist, the remote computer browser requests the HTTP transfer of the graphics file 1106 from the security panel. Once received from the security panel in response 1108, the graphics file is locally stored (in cache directory) and is displayed on the browser screen. The HTML file then instructs the execution of a communications program. Again, if the current version of the file does not locally exist, the remote computer browser makes a request 1110 for the HTTP transfer of the file from the security panel. Once received from the security panel in response 1112, the communications program file is locally stored and immediately executed at 1114. This program runs in tandem with the existing browser software and does not prevent or hinder any normal browser activity.

Once started, the communications program begins a continuous polling sequence, requesting the status of the various points via a status request 1116. When the communications program receives the response status messages 1118, all the icons overlaying the graphics screen are repainted to indicate the current status of the points.

d. Mobile-Security Panel Communications

Figure 12:
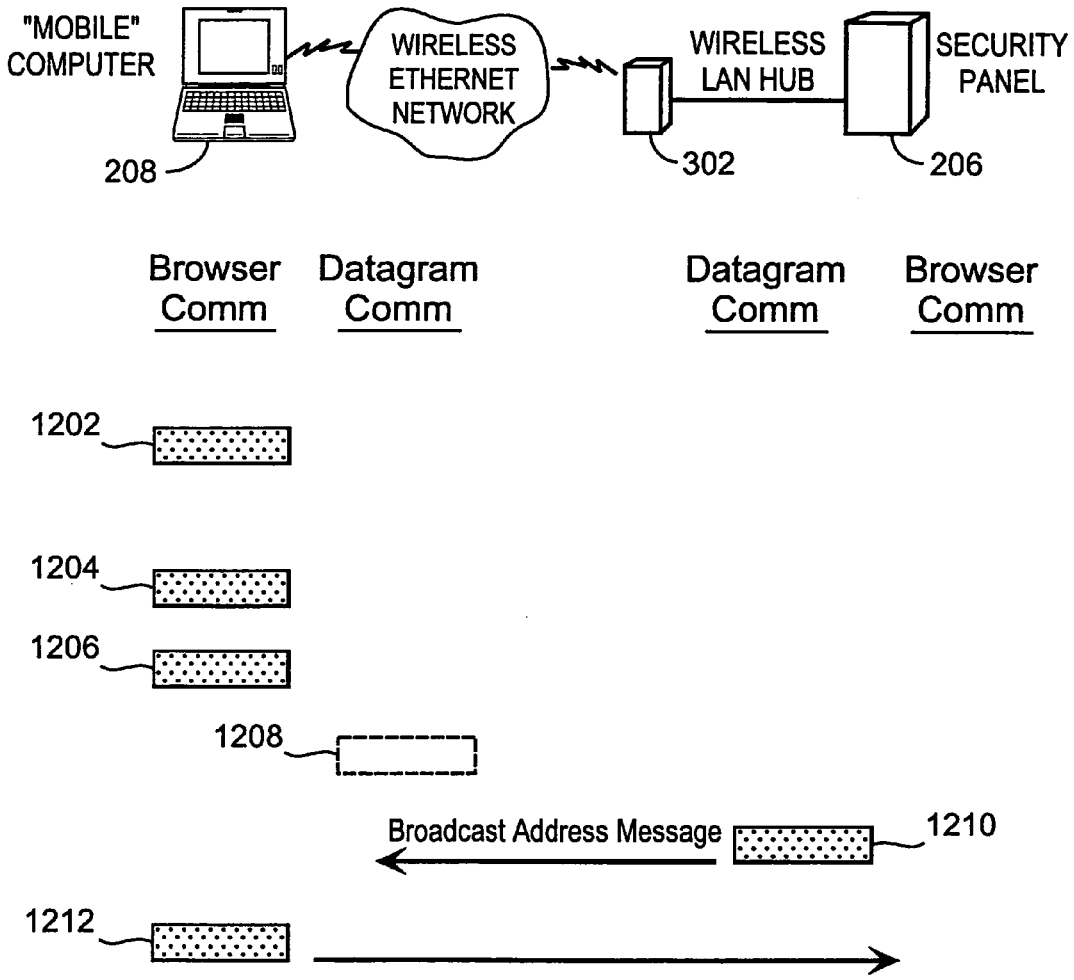
FIG. 12 shows exemplary communications between the security panel and the mobile computer.

FIG. 12 details communications between the mobile computer 208 and the security panel 207. The mobile computer 208 gains access to the security panel through a wireless local area network, enabled by the wireless LAN hub 302 and/or any available wireless network including, but not limited to existing cellular telephone networks. The mobile computer browser software is executed, referencing a locally held web page 1202. The HTML file references both a graphics display file 1204 and an encapsulated communications program 1206 (which is already installed in the mobile computer). After the screen is painted with the graphics image, the communications program is executed at 1208. This program continues to search via the wireless interface card for a broadcast packet containing an address, such as an encrypted IP address, of the local security panel. Once the BROADCAST ADDRESS message 1210 is received by the mobile computer communications program, the address is decrypted and the browser is directed (hyperlinked 1212) to the IP address of the security panel. Execution after this point is identical to the remote-security panel communications, and reference is made to the description of FIG. 9 regarding the connection activities.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for monitoring a space, comprising:

a security panel located at the space, said security panel having a plurality of sensors; and a monitoring system for receiving real time information regarding the space from the security panel over a network using a network protocol, said monitoring system including a graphic interface to display said information as multistate outputs associated with each of said plurality of sensors.

2. Apparatus according to claim 1, wherein the network is an Ethernet network.

3. Apparatus according to claim 1, wherein the monitoring system includes encapsulated communications programs.

4. Apparatus according to claim 1, wherein said information is received using a standard Internet browser.

5. Apparatus according to claim 1, wherein said information is displayed using a bitmap representation of said space, with icons overlaid on said bitmap to identify said sensors and their status.

6. Apparatus according to claim 1, wherein said information is displayed using an icon on a display to represent a condition of each sensor.

7. Apparatus according to claim 6, wherein said condition can be any of said multistate outputs, at least a first of said multistate outputs being an indication that a sensor is in an alarm condition, a second of said multistate outputs being an indication that said sensor was recently in an alarm condition, and a third of said multistate outputs being an indication that said sensor is not in an alarm condition.

8. Apparatus in accordance with claim 7, wherein said condition can further be an indication that said sensor has been disabled.

9. Apparatus in accordance with claim 7, wherein said condition can further be an indication that said sensor has been failed.

10. Apparatus in accordance with claim 1, wherein monitoring of said display can distinguish false alarms from genuine alarms.

11. Apparatus according to claim 1, wherein monitoring of said display can be used to track sequential activation of said sensors, yet provide information regarding the most recent sensor placed into an alarm condition.

12. Apparatus according to claim 1, comprising:

a remote monitoring system which can access said information.

13. Apparatus according to claim 1, comprising:

a mobile computer which can access said information.

14. Apparatus according to claim 1, wherein said information can be displayed as a hierarchy of display screens, with at least one level of said hierarchy of screen displays showing multiple facilities being monitored, and with at least one additional level of said hierarchy providing access to floor plans for any of said facilities.

15. Apparatus according to claim 13, wherein said mobile computer includes:

means for accessing information contained within said security panel via use of an encrypted address message broadcast by at least one of said mobile computer and said security panel.

16. Apparatus according to claim 15, wherein said mobile computer accesses said information via a wireless network.

17. Apparatus according to claim 16, wherein said wireless network includes a cellular telephone network.

18. Apparatus for monitoring a space, comprising:

a security panel located at the space; and a supervisory monitoring system for receiving real time information regarding the space from the security panel monitoring system over a network, said monitoring system including a graphic interface to display information that distinguishes false alarms from actual alarms.

19. Apparatus according to claim 18, wherein the network is an Ethernet network.

20. Apparatus according to claim 18, wherein the monitoring system includes encapsulated communications programs.

21. Apparatus according to claim 18, wherein said information is received using a standard Internet browser.

22. Apparatus according to claim 18, wherein said information is displayed using a bitmap representation of said space, with icons overlaid on said bitmap to identify said sensors and their status.

23. Apparatus according to claim 18, wherein said information is displayed using an icon on a display to represent a condition of each sensor.

24. Apparatus according to claim 23, wherein said condition can be any one of multistate outputs, at least a first of said multistate outputs being an indication that a sensor is in an alarm condition, a second of said multistate outputs being an indication that said sensor was recently in an alarm condition, and a third of said multistate outputs being an indication that said sensor is not in an alarm condition.

25. Apparatus according to claim 18, wherein monitoring of said display can be used to track sequential activation of said sensors, yet provide information regarding the most recent sensor placed into an alarm condition.

26. Apparatus according to claim 18, wherein said information can be displayed as a hierarchy of display screens, with at least one level of said hierarchy of screen displays showing multiple facilities being monitored, and with at least one additional level of said hierarchy providing access to floor plans for any of said facilities.

27. Apparatus according to claim 18, wherein said supervisory monitoring system is a mobile computer which includes:

means for accessing information contained within said security panel via use of an encrypted address message broadcast by at least one of said mobile computer and said security panel.

28. Method for monitoring a space, comprising the steps:

locally monitoring outputs from a plurality of sensors located at the space; and transmitting information associated with a status of said sensors, in real time, over a network using a network protocol, to a supervisory monitoring system, said information representing multistate outputs associated with each of said plurality of sensors.

29. Method according to claim 28, wherein said information is transmitted using encapsulated communications programs and a standard Internet browser.

30. Method according to claim 28, wherein said information transmitted to said supervisory monitoring system is displayed at the supervisory monitoring system using a bitmap representation of said space, with icons overlaid on said bitmap to identify said sensors and their status.

31. Method according to claim 30, wherein a status of each of said sensors is constituted by any one of multistate outputs, at least a first of said multistate outputs being an indication that a sensor is in an alarm condition, a second of said multistate outputs being an indication that said sensor was recently in an alarm condition, and a third of said multistate outputs being an indication that said sensor is not in an alarm condition.

32. Method according to claim 28, wherein said information can be displayed at said supervisory monitoring system as a hierarchy of display screens, with at least one level of said hierarchy of screen displays showing multiple facilities being monitored, and with at least one additional level of said hierarchy providing access to floor plans for any of said facilities.

33. Method according to claim 28, wherein said supervisory monitoring system is a mobile computer which accesses information contained within a security panel at said space via use of an encrypted address message broadcast by at least one of said mobile computer and said security panel.

* * * * *